US009127854B2

(12) United States Patent
Briar et al.

(10) Patent No.: US 9,127,854 B2
(45) Date of Patent: Sep. 8, 2015

(54) DAMPER VANE AND HOUSING CONSTRUCTION

(75) Inventors: Scott Michael Briar, Zhuhai (CN); Michael J McQueeny, Leawood, KS (US)

(73) Assignee: AIRFIXTURE LLC, Kansas City, KS (US)

( * ) Notice: Subject to any disclaimer, the term of this patent is extended or adjusted under 35 U.S.C. 154(b) by 819 days.

(21) Appl. No.: 13/445,909

(22) Filed: Apr. 12, 2012

(65) Prior Publication Data

US 2013/0273831 A1 Oct. 17, 2013

(51) Int. Cl.

| | |
|---|---|
| ***F24F 7/00*** | (2006.01) |
| ***F24F 13/08*** | (2006.01) |
| ***F24F 13/06*** | (2006.01) |
| ***F24F 13/20*** | (2006.01) |
| ***F24F 13/14*** | (2006.01) |

(52) U.S. Cl.

CPC ..... *F24F 13/20* (2013.01); *F24F 13/14* (2013.01); *F24F 2013/1433* (2013.01)

(58) Field of Classification Search

USPC ..... 454/363, 275, 48, 252, 256, 320, 369, 454/160, 155, 333

IPC ..... F24F 13/20

See application file for complete search history.

(56) References Cited

U.S. PATENT DOCUMENTS

| | | | | |
|---|---|---|---|---|
| 3,785,628 | A * | 1/1974 | Lang | 261/65 |
| 5,238,453 | A * | 8/1993 | Heil | 454/335 |
| 5,492,097 | A * | 2/1996 | Byram et al. | 123/396 |
| 6,019,677 | A | 2/2000 | Demster | |
| 6,099,406 | A | 8/2000 | Demster | |
| 6,945,866 | B2 | 9/2005 | Demster | |
| 6,986,708 | B2 | 1/2006 | Demster | |
| 6,997,389 | B2 | 2/2006 | Demster | |
| 6,997,799 | B2 | 2/2006 | Mrozek | |
| 7,025,672 | B2 | 4/2006 | Mrozek et al. | |
| 7,089,958 | B2 | 8/2006 | Schlosser et al. | |
| 7,241,217 | B2 | 7/2007 | Demster | |
| 2007/0066213 | A1 | 3/2007 | Helgeson et al. | |

* cited by examiner

*Primary Examiner* — Steven B McAllister
*Assistant Examiner* — Helena Kosanovic
(74) *Attorney, Agent, or Firm* — Shook, Hardy & Bacon L.L.P.

(57) ABSTRACT

A damper having a housing includes a rotatable damper vane therein constructed to minimize the passage of air between the vane and the housing when the vane is in a closed position. The housing includes a pair of opposed walls having a channel or flute therein adjacent outer edges of the vane when the vane is in the closed position. The outer edges of the vane terminate in domed or arcuate shaped surfaces that generally correspond with the channel. The arcuate shaped surfaces are a distance apart that is greater than a distance between the opposed walls such that the arcuate shaped surfaces are received in the channels when the vane is in the closed position. The housing also includes a pair of opposed sidewalls having a ridge therein at a location that aligns with an edge of the vane when the vane is in the closed position.

26 Claims, 9 Drawing Sheets

DAMPER VANE AND HOUSING CONSTRUCTION

CROSS-REFERENCE TO RELATED APPLICATIONS

Not applicable.

STATEMENT REGARDING FEDERALLY SPONSORED RESEARCH OR DEVELOPMENT

Not applicable.

BRIEF SUMMARY OF THE INVENTION

The present invention relates to damper vanes. More particularly, this invention relates to a damper construction that reduces the amount of airflow around a damper in a closed position while permitting construction of a housing that allows for greater tolerances between the vane and the housing in non-closed positions.

Dampers consisting of a damper vane which rotates within a housing to selectively restrict and permit the passage of air through the housing are well known in the art. One particular construction known to be beneficial is disclosed in U.S. Patent Application Publication No. 2007/0066213 A1, which is incorporated herein in its entirety. It discloses a damper coupled with an air delivery assembly to create a floor terminal for use in a raised floor air distribution system. The vane of the damper opens and closes a passageway to selectively permit air to pass therethrough from a plenum under the raised floor, into the air delivery system and then up into a room through the floor.

As best illustrated in FIGS. 3 and 4 thereof, the damper has a generally rectangular frame 16 that surrounds a generally rectangular vane 22. The vane is sized to generally fill the opening defined by the frame when it is in the closed position of FIG. 3. However, because the edges of the vane do not contact the frame, air may still pass around the edges of the vane between the vane and the walls of the frame. In order to minimize the amount of air that passes around the vane in the closed position, the vane can be made larger. However, tolerances become very critical. If the walls of the frame are not parallel and square, the vane can rub on the metal walls, creating wear, noise, and decreased product life. Consequently, a gap is left around the edge of the vane to ensure that the vane does not contact the frame during rotation. This gap results in continual air passage around the vane, even when it is in the closed position.

To create a damper with improved air flow stoppage capabilities, a damper was created with recessed areas for receiving a portion of the vane and limited reduced dimension portions for getting closer to edges of the vane in a desired orientation. The damper has a housing that defines a passage therethrough. The housing includes longitudinal channels facing each other and aligned with the vane positioned in the passage. The vane is sized such that it is larger than the passage in one direction so that edges of the vane are received in the channels in the closed position. The housing also includes raised ridges in sidewalls of the housing in a position adjacent edges of the vane in its closed position.

Further objects, features and advantages of the present invention over the prior art will become apparent from the detailed description of the drawings which follows, when considered with the attached figures.

BRIEF DESCRIPTION OF THE SEVERAL VIEWS OF THE DRAWINGS

The features of the invention noted above are explained in more detail with reference to the embodiment illustrated in the attached drawing figures, in which like reference numerals denote like elements, in which FIGS. 1-16 illustrate one possible embodiment of the present invention, and in which:

FIG. 1 is a top right perspective view of an air terminal having a damper with a vane constructed in accordance with an embodiment of the present invention;

FIG. 2 is a cross-sectional top left perspective view of the terminal of FIG. 1 taken along the line 2-2 thereof;

FIG. 3 is a fragmentary left side elevation view in cross-section taken along the line 3-3 of FIG. 2;

FIG. 4 is an enlarged side elevation view of the area 4 of FIG. 3;

FIG. 5 is fragmentary top plan view in cross-section taken along the line 5-5 of FIG. 1;

FIG. 6 is an enlarged top plan view of the area 6 of FIG. 5;

FIG. 7 is a fragmentary back side elevation view in cross-section taken along the line 7-7 of FIG. 1;

FIG. 8 is an enlarged back side elevation view of the area 8 of FIG. 7;

FIG. 9 is an exploded, fragmentary, top right perspective view of the motor and control housing of the damper of FIG. 1;

FIG. 10 is a top right perspective view of the vane coupled with the motor with other portions of the terminal removed for clarity;

FIG. 11 is an exploded view of FIG. 10;

FIG. 12 is a rear perspective view of a drive bearing of an embodiment of the present invention;

FIG. 13 is a front side elevation view of the drive bearing of FIG. 12;

FIG. 14 is a rear perspective view of a follow bearing of an embodiment of the present invention;

FIG. 15 is a front side elevation view of the follow bearing of FIG. 14; and FIG. 16 is a fragmentary cross-sectional view of the combination of FIG. 10 taken along the line 16-16.

DETAILED DESCRIPTION OF THE INVENTION

Figure 1:
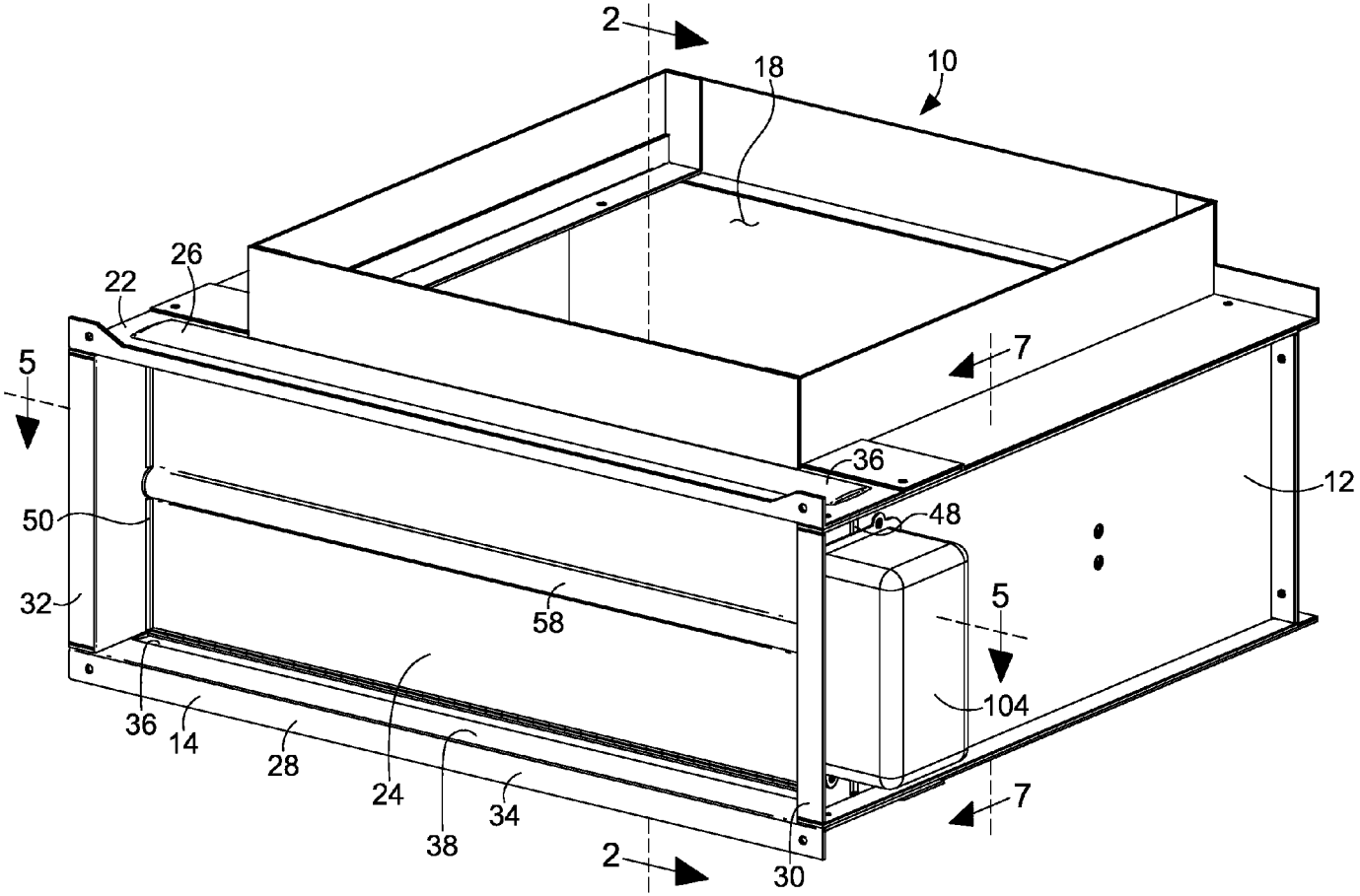
Figure 2:
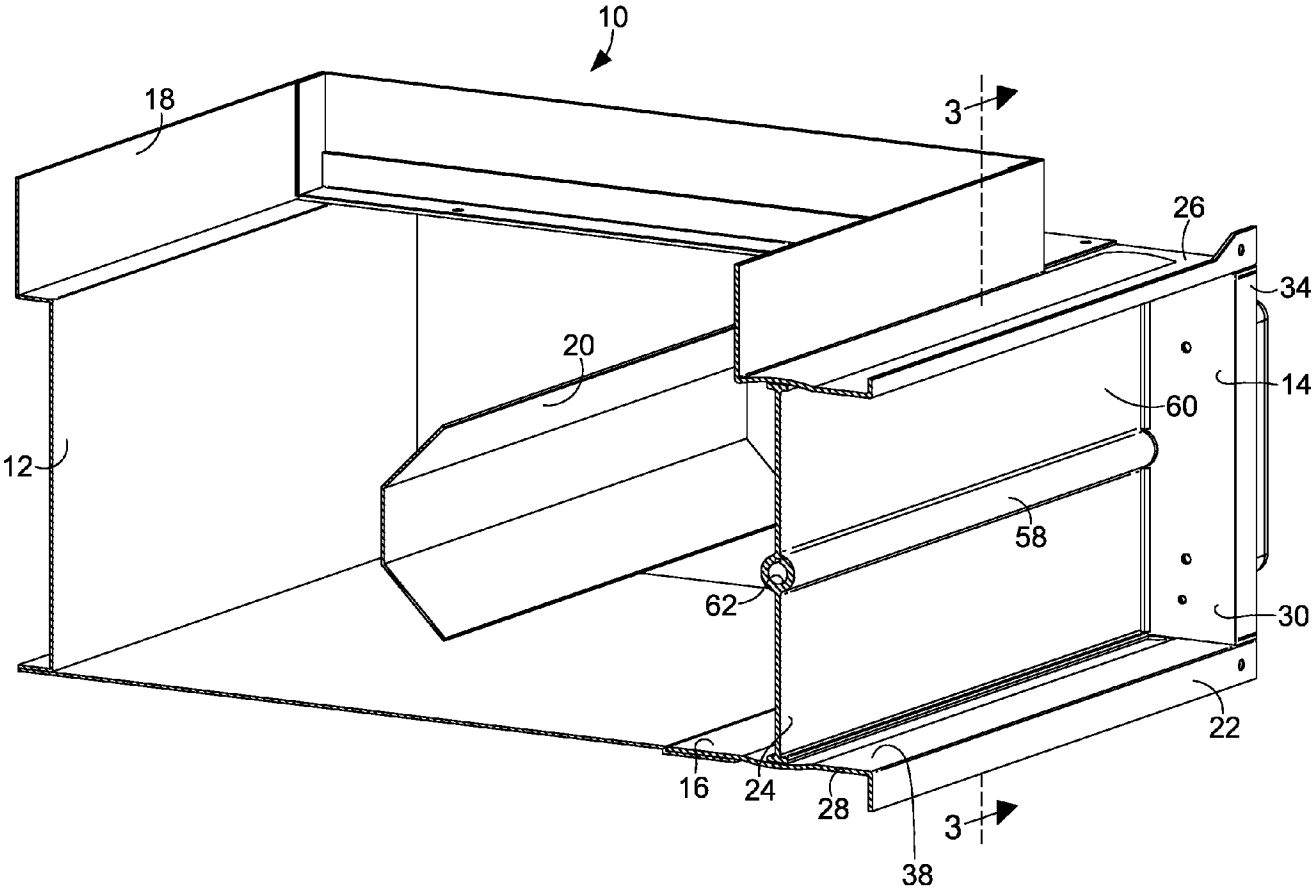

Referring now to the drawings in more detail and initially to FIG. 1, numeral 10 generally designates an air terminal constructed in accordance with an embodiment of the present invention. The air terminal 10 has an air delivery assembly 12 coupled with a damper 14. The air terminal 10 may be positioned in an opening in a raised floor air distribution system (not shown) to control the passage of conditioned air from a plenum under the raised floor up into a room to be heated or cooled. The air delivery assembly 12 generally defines a box-like structure having a lateral opening 16 and a top opening 18. The lateral opening 16 is covered by the damper 14, which selectively controls the flow of air into the air delivery assembly 12. The air then exits the air delivery assembly 12 up through the top opening 18 and flows into the room.

The top opening 18 may receive a grate or grate assembly (not shown) to cover the top opening 18, but still let air to flow therethrough. The air delivery assembly 12 may also include one or more baffles 20 to affect the flow of air through the air delivery assembly 12 and out into the room. While the opening 16 has been identified as a lateral opening and illustrated as being on a side of the air delivery assembly 12, the opening 16 may be on the bottom of the air delivery assembly 12. Similarly, while the damper 14 has been illustrated as being coupled to the air delivery assembly 12, the damper 14 has utility apart from the air delivery assembly 12 and may be used with or without the air delivery assembly 12. In that regard, the damper 14 may be coupled directly to the bottom of a grate or grate assembly.

Turning now to the damper 14, it includes a housing 22 and a damper vane 24. The housing 22 generally forms a frame around the vane 24 and includes a top wall 26, a bottom wall 28, a right sidewall 30 and a left sidewall 32. The top and bottom walls 26 and 28 are generally planar and generally parallel to each other. Similarly, the right and left sidewalls 30 and 32 are also generally planar and are also generally parallel to each other. The top and bottom walls 26, 28 are spaced apart from each other by the right and left sidewalls 30, 32. As such, the right and left sidewalls 30, 32 are generally perpendicular to the top and bottom walls 26, 28. While each of the walls 26, 28, 30, 32 are indicated as being generally planar, they may include flanges 34 for strength and to permit readily coupling of the housing 22 with other items. They may also include various formations therein which will be discussed below.

Each of the top and bottom walls 26, 28 include a longitudinal channel 36 therein. The channel provides a dip or recess along interior faces 38 of the top and bottom walls 26, 28 along their length to receive a portion of the vane 24, as discussed below. The channels 36 permit the housing 22 to receive a vane 24 with a width dimension 40 that is greater than a normal distance 42 between the top and bottom walls 26, 28 outside of the channel 36. The opposed channels 36 provide an increased opening dimension 44 when measured between a low point 46 of the channel 36 to the low point 46 of the oppose channel 36. The low point 46 actually runs along the longitudinal length of both channels 36 and represents a low line along a longitudinal axis of the channels 36. Consequently, the distance 44 between the low lines 46 is greater than the width dimension 40 of the vane 24, which itself is greater than the normal distance 42 between the top and bottom wall 26, 28 outside of the channel 36. The importance of this will be discussed below.

Figure 5:
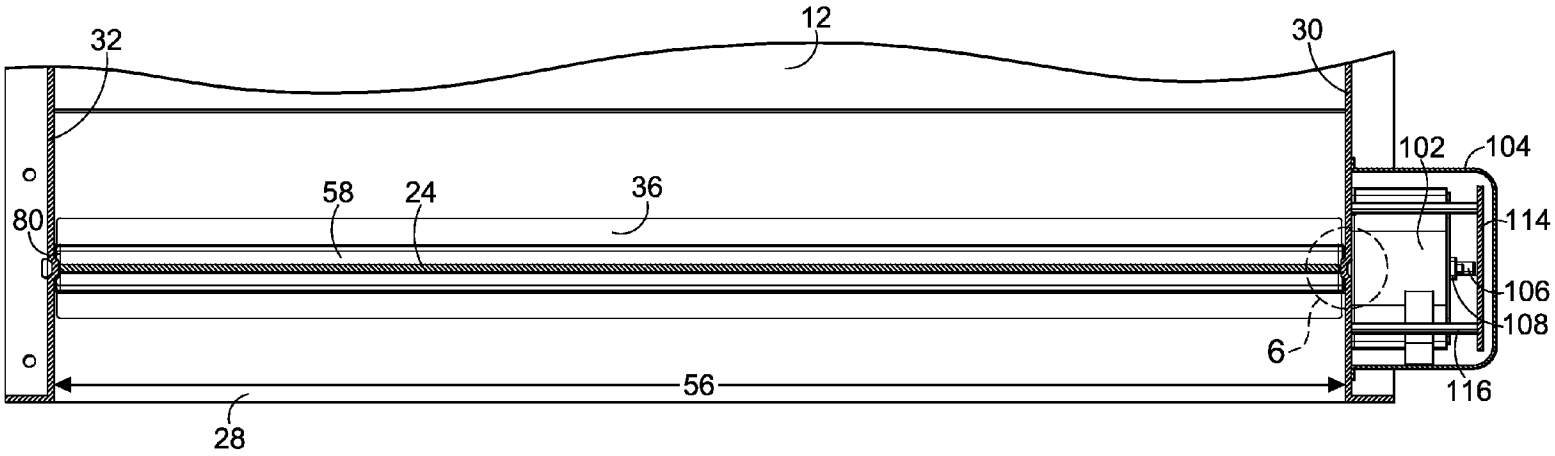
Figure 6:
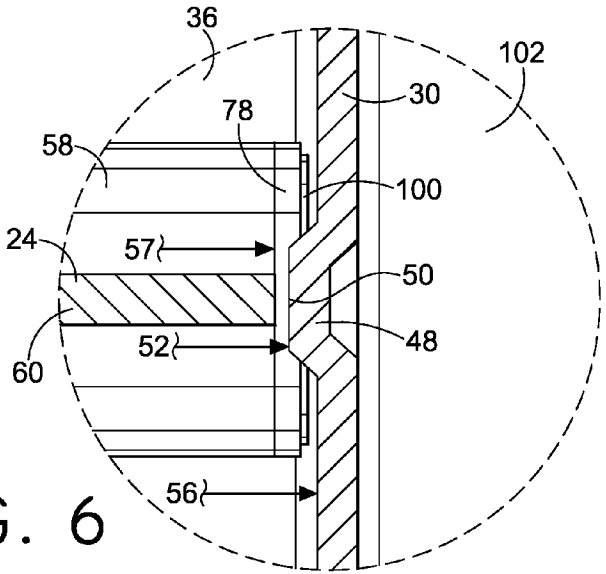

The sidewalls 30, 32 include a ridge 48. The ridge, best seen in FIG. 6, is preferably a raised portion of the sidewalls 30, 32 that extends along the sidewalls in a line. In the illustrated embodiment, the ridges 48 are vertical and extend from the top wall 26 to the bottom wall 28. An apex of the ridge 48 (which is really more of a plateau) forms a high line 50 which extends along the apex of the ridge 48. The ridges 48 of the sidewalls 30, 32 face each other to create an area through the housing 22 of a reduced dimension. As illustrated, it creates a reduced width dimension 52. In that regard, the walls 26, 28, 30, 32 cooperate to define a passage 54 through which conditioned air may pass through the damper 14 and into the lateral opening 16 of the air delivery system 12. The sidewalls 30, 32 have a normal distance 56 therebetween, as illustrated in FIGS. 5 and 6. The ridges 48 create the reduced width dimension 52, for reasons that will be discussed below. The reduced width dimension 52, while less than the normal distance 56 between the sidewalls 30, 32, is greater than a length dimension 57 of the vane 24. The apex of the ridges 48 are coplanar with the low lines 46 of the channels 36.

The vane 24 is generally a plate like member having a central longitudinal body 58 and a pair of opposed wings 60. The body 58 in the illustrated embodiment takes the shape of a cylindrical tube with a bore 62 therethrough. The bore 62 has a central longitudinal axis 64 about which the vane 24 rotates during operation. The wings 60 have a proximal edge 66 and a distal edge 68. The edges 66, 68 are parallel to each other and parallel to the central longitudinal axis 64. The distal edges 68 can also be called outer or longitudinal edges 68. The wings 60 are coupled with the body 58 at the proximal edges 66.

Figure 4:
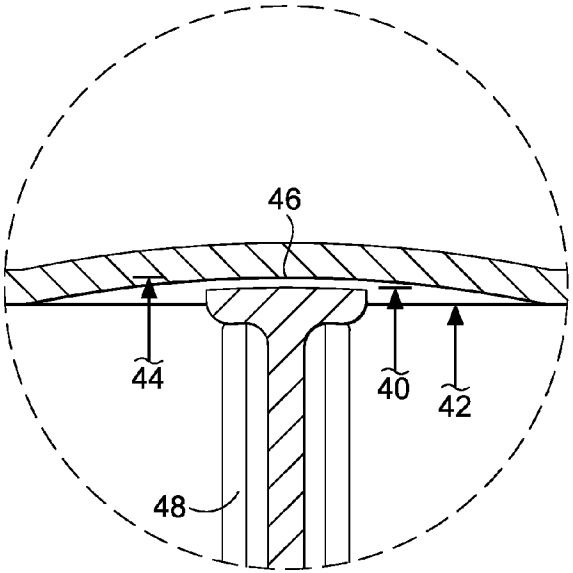
Figure 3:
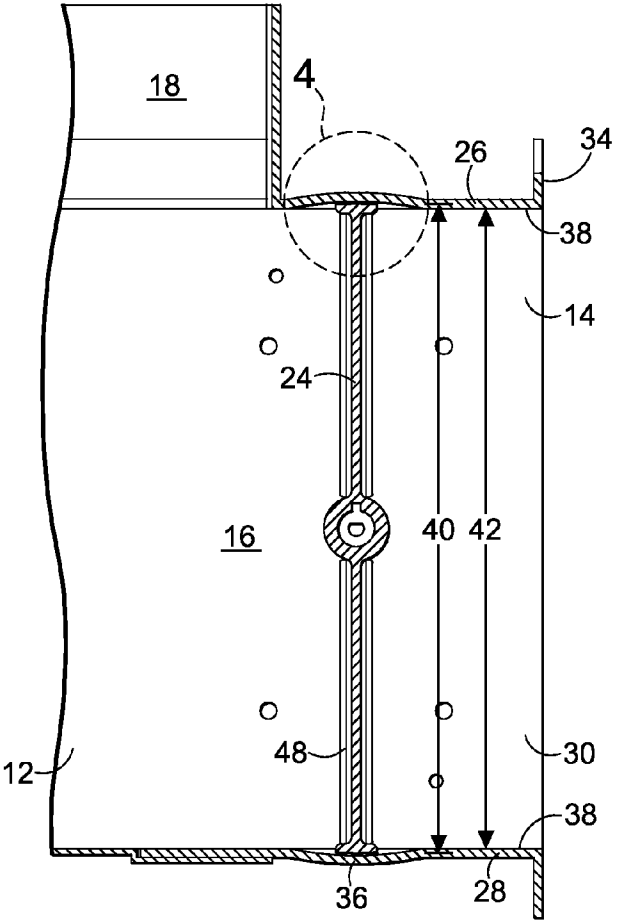

While the lateral edges 66 may terminate with just a square profile, as best depicted in FIG. 4, the longitudinal edges 68 preferably include a flange 70 which creates a T-shaped cross section. The flange 70 preferably runs along the length of the outer edge and includes an outer surface 72 which is preferably bowed outwardly or of an arcuate shape. In one embodiment, the outer surface 72 has a radius from the central longitudinal axis 64 that is slightly less than a radius that defines the channel 36. In one embodiment, the radius for the outer surface 72 is 2.410 inches and the radius of the channels 36 is 2.430 inches, thereby leaving a 0.020 inch gap between the outer edge 68 of the vane 24 and the channels 36 when the vane 24 is in the closed position illustrated in FIGS. 1-4. Other dimensions are within the scope of the present invention. The width dimension 40 is the distance between the outer surfaces 72 of the flanges 70 of the vane 24.

The vane 24 also has a pair of opposed transverse or lateral edges 74. These edges 74 extend between the flanges 70 and, when the vane 24 is in the closed position, align with the ridges 48 in the sidewalls 30, 32, as illustrated in FIGS. 2, 3, and 5-7. As such, the ridges 48, which are coplanar with the wings 60 of the vane 24 when the vane 24 is in the closed position, decrease the gap around the lateral edges 74 of the vane 24 when in the closed position, but allow for a larger tolerance or gap between the vane and sidewalls 30, 32, when the vane 24 is turning. In one embodiment, the raised rib has a height dimension of 0.05 inches to create a 0.02 inch gap between the vane 24 and the sidewalls 30, 32 in the closed position, while allowing a 0.07 inch gap between the lateral edges 74 of the vane 24 and the sidewalls 30, 32 on either side of the ridges 48 while the vane 24 is turning and is in the non-closed position. The length dimension 57 is the distance between the lateral edges 74 and the vane 24.

Figure 8:
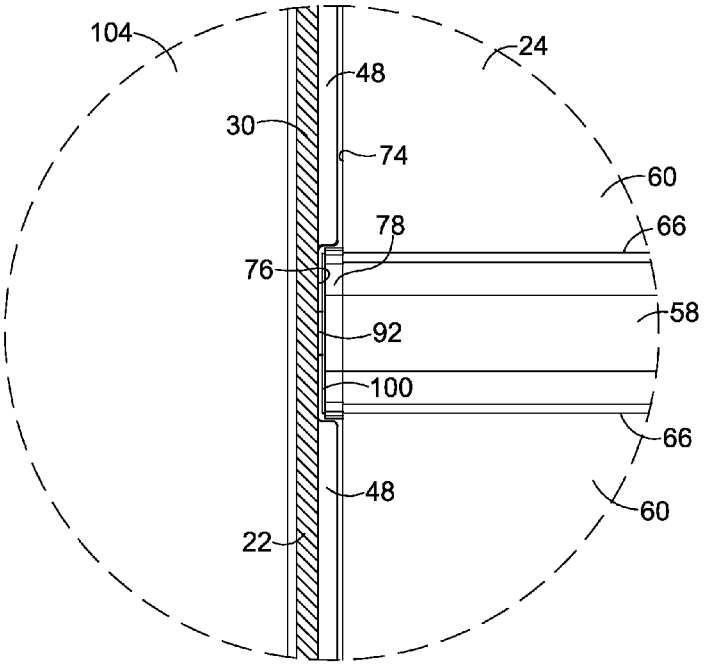
Figure 7:
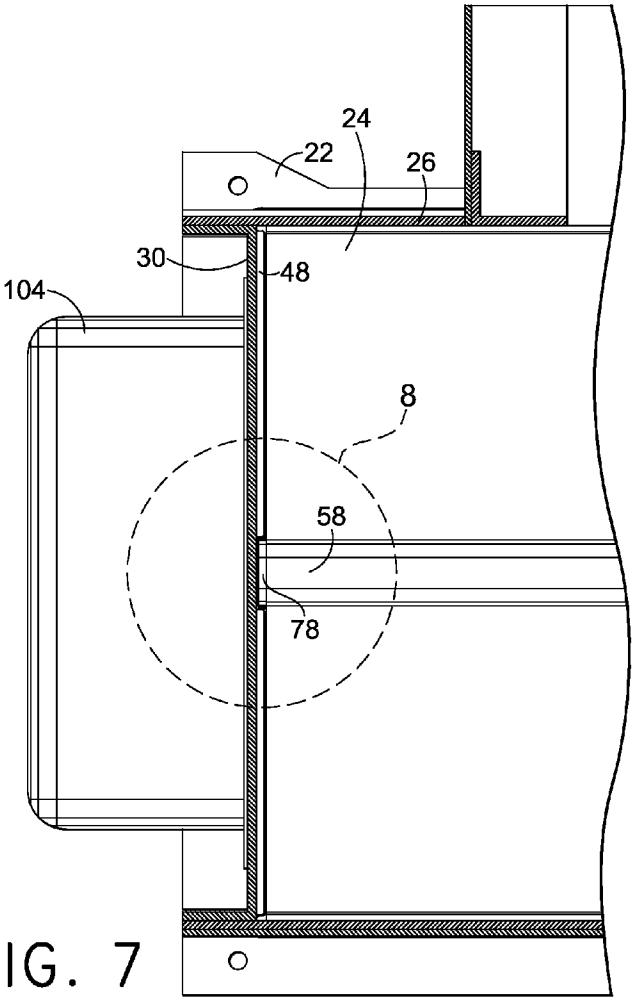
Figure 9:
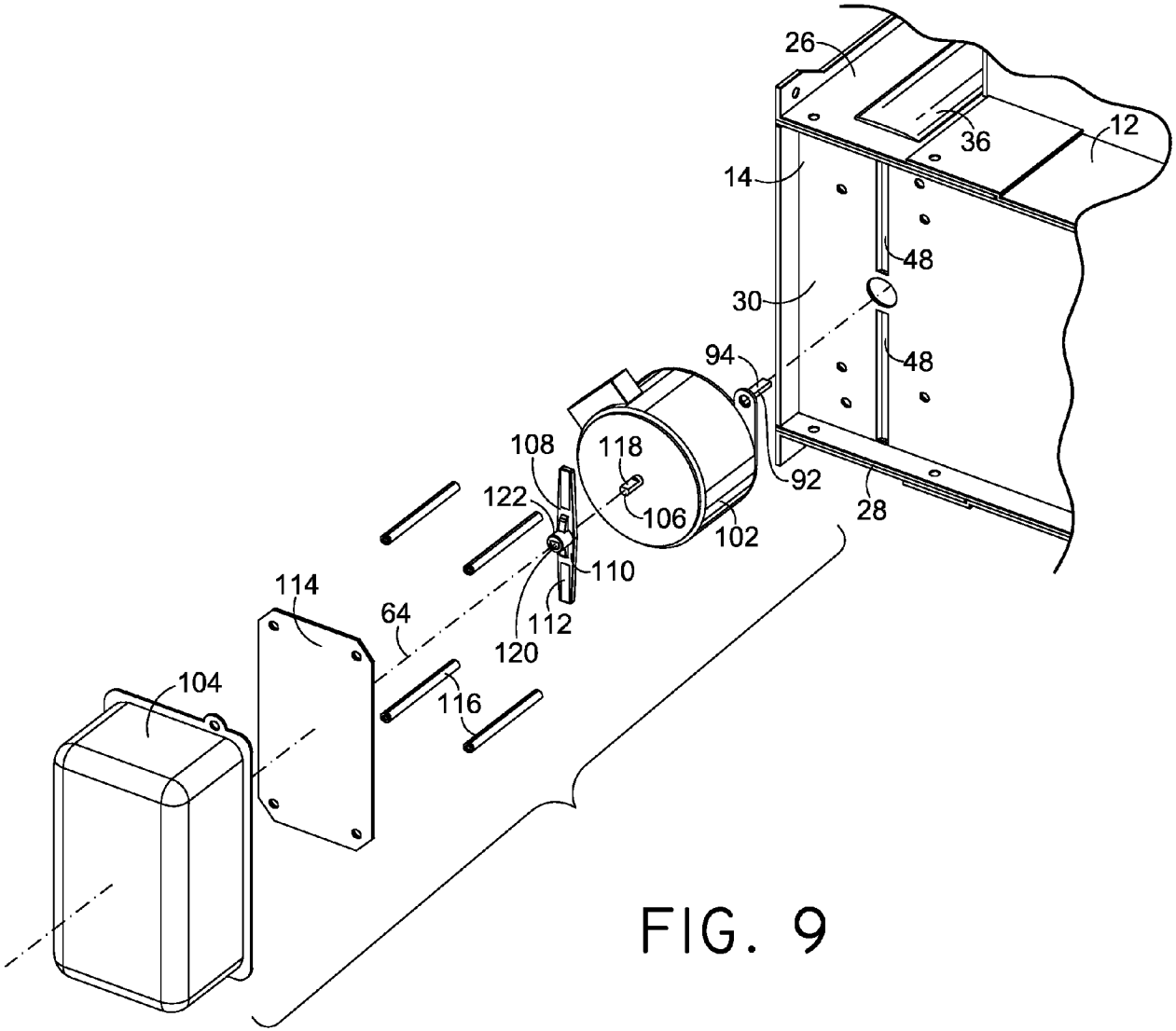
Figure 10:
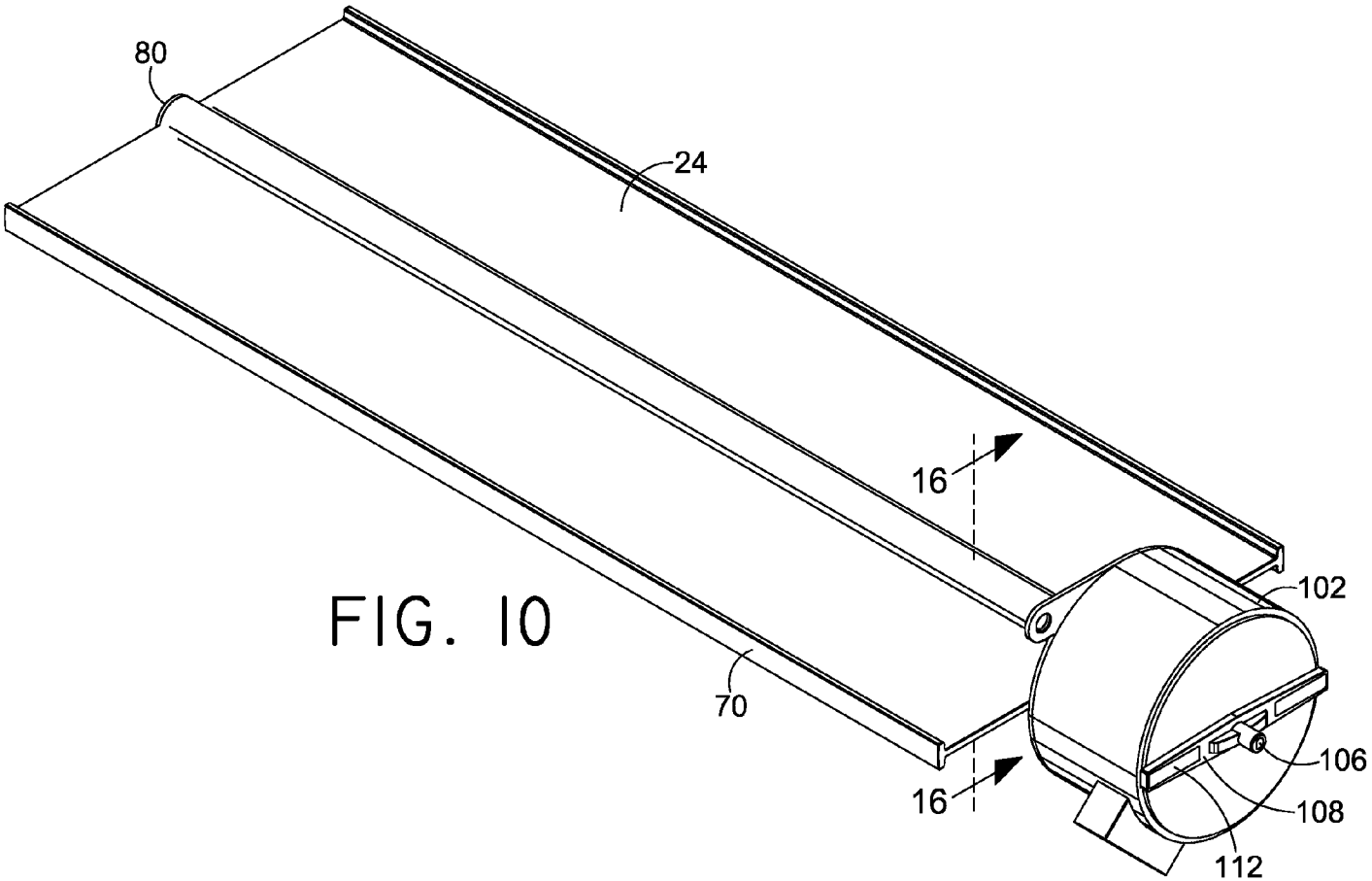
Figure 11:
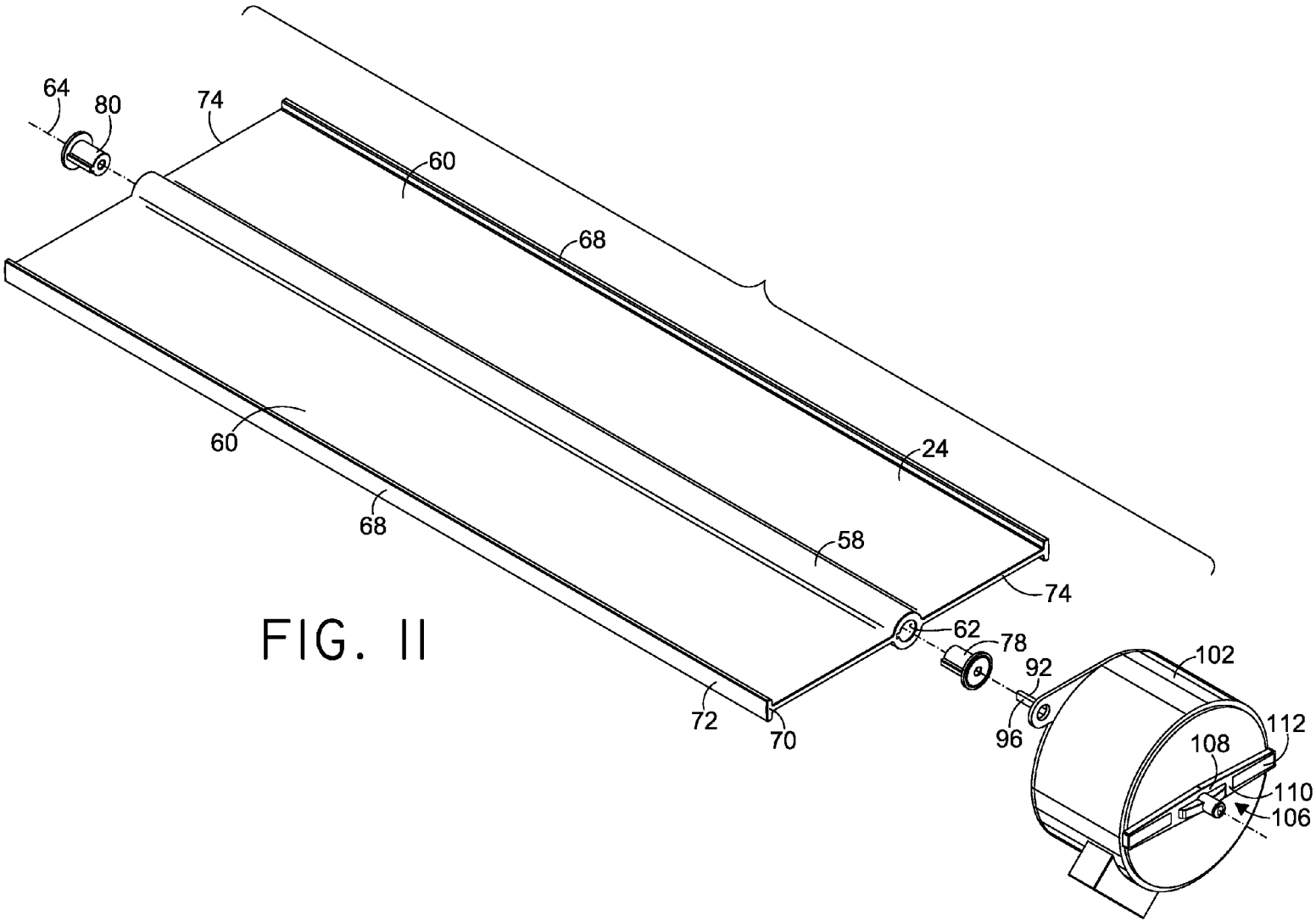
Figure 12:
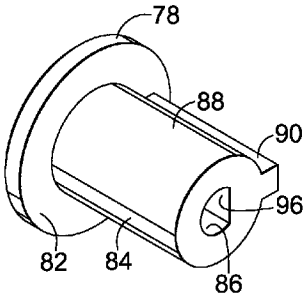
Figure 13:
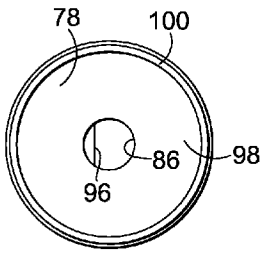
Figure 14:
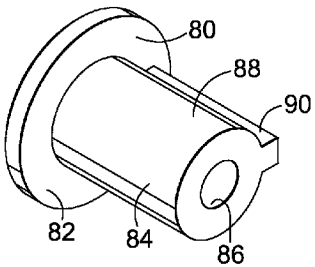
Figure 15:
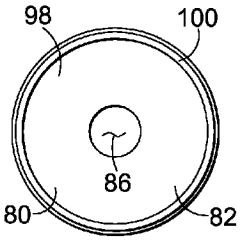
Figure 16:
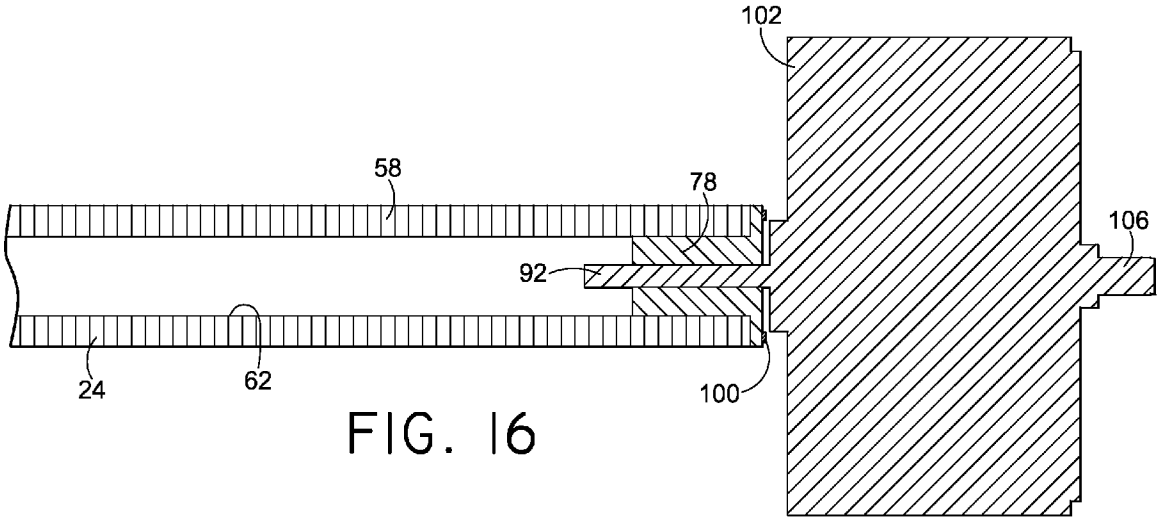

As best illustrated in FIG. 8, the ridge 48 in the sidewalls 30, 32 may have a flattened area 76 which divides the ridge 48 into two aligned ridge segments. The flattened areas 76 receive bearings 78, 80 that help couple the vane 24 with the housing 22. In that regard, the bearing 78 may be a drive bearing 78, as depicted in FIGS. 11, 12, 13 and 16. The bearing 80 may take the form of a follower bearing 80, as depicted in FIGS. 11, 14 and 15. The bearings 78, 80 include a disc-shaped flange 82 coupled with a generally tubular body 84. The body 74 has a central longitudinal bore 86 therethrough. On an outer surface 88 of the body 84, the bearings 78, 80 have a key 90 thereon. The body 84 of the bearings 78, 80 is received in the bore 62 of the body 58 of the vane 24. The keys 90 prevent rotation of the bearings 78, 80 with respect to the vane 24. In other words, the body 84 of the bearings 78, 80 does not rotate inside the bore 62 of the vane 24, but instead rotate therewith. The vane is coupled with the sidewalls 30, 32 by receiving a pin (not shown) or a drive shaft 92 in the bores 86 of the bearings 78, 80.

The pin extends inwardly from the left sidewall 32 and is received in the bore 86 of the follower bearing 80. The follower bearing 80 then rotates on the pin as the vane 24 rotates. Similarly, the drive shaft 92 is received in the bore 86 of the drive bearing 78. To permit the drive shaft 92 from rotating in the bore 86 of the drive bearing 78, the drive shaft 92 preferably has a non-round profile. In the illustrated embodiment, the drive shaft 92 has a generally cylindrical shape, but for a flattened area 94. The bore 86 of the drive bearing 78 preferably has a corresponding flattened area 96. Accordingly, when the drive shaft 92 rotates, it turns the drive bearing 78, which in turn rotates the vane 24 in the passage 54 of the housing 22 of the damper 14. An outer surface 98 of the flange of the bearings 78, 80 may include an annular raised ring or rib 100. The rib 100 provides a reduced surface area from the outer surface 98 of the bearing and represents a decreased friction should the bearings 78, 80 come in contact with the sidewalls 30, 32 during rotation of the vane 24. The bearings 78, 80 may be made out of a reduced friction material (e.g., nylon).

The drive shaft 92 is powered by a motor 102 that is contained within a motor housing 104. The motor 102 may be of any type suitable to rotate the drive shaft 92. One particular motor of a type that has been found to be beneficial, is disclosed in U.S. Pat. No. 7,241,217, which is incorporated herein in its entirety by reference. The motor 102 in the present invention, however, includes a secondary rotary output 106. The secondary rotary output 106, which is preferably on an opposite side of the motor 102 is preferably coaxial with the drive shaft 92. An arm 108 is preferably coupled with the secondary rotary output 106 such that the secondary rotary output rotates the arm 108 in a circular path when the motor 102 rotates both the drive shaft 92 and the secondary rotary output 106. The arm 108 preferably has an outer surface 110 that includes a reflective portion 112 which can be used in connection with a sensor (not shown) to determine the orientation of the arm 108. The orientation of the arm 108 can be used to determine the orientation of the vane 24, as the arm 108 is coupled with the vane 24 via the secondary rotary output 106 and the drive shaft 92. The sensor may be part of the electronics which control activation of the motor 102 and, in turn, the damper 14. The electronics may be positioned on a control or circuit board (not shown) coupled to a plate 114 that is mounted on the right sidewall 30 adjacent the motor 102 via posts 116, all of which may be concealed inside the motor housing 104. To assure that the arm 108 does not get out of alignment with the vane 24, the secondary rotary output may include a flattened portion 118 that corresponds with a flattened portion 120 in a bore 122 in the arm 108, similar to the arrangement between the drive shaft 92 and the drive bearing 78.

Unlike the floor terminal disclosed in U.S. Patent Publication No. 2007/0066213, where the damper is separate from but coupled to the air delivery system, the damper 14 of the present invention may be made integral with the air delivery system 12. In that regard, portions of the housing 22 can also be portions of the air delivery system 12. For example, as illustrated in FIG. 1, the right sidewall 30 may extend laterally rearward to form a part of the box that makes up the air delivery system 12. Similarly, the left sidewall 32 may form a left wall of the air delivery system 12. Each of the walls 26, 28, 30, 32 of the housing, as well as the vane 24 and the walls of the air delivery system 12, may be formed out of sheet metal. The sheet metal may be bent to include various flanges for coupling together adjacent components and/or coupling the air terminal 10 with its surroundings or other components, such as with the raised floor system.

Accordingly, the present invention discloses a damper construction with improved reduced airflow when in a closed position. Many variations can be made to the illustrated embodiment of the present invention without departing from the scope of the present invention. Such modifications are within the scope of the present invention. For example, the channels 36 could be replaced with additional ridges 48. Other modifications would be within the scope of the present invention.

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A damper comprising:

a housing having an upper wall, a lower wall, a first sidewall, and a second sidewall, wherein the upper wall is spaced apart from and generally faces the lower wall, wherein the first sidewall is spaced apart from and generally faces the second sidewall, wherein the upper and lower walls are connected to the first and second sidewalls, wherein the upper and lower walls and the first and second sidewalls cooperate to define an air passage therethrough, and wherein the upper and lower walls include a channel; and a damper vane positioned in the air passage and rotatably connected to the housing, wherein the vane includes a central axis about which the vane rotates, wherein the vane includes outer edges spaced apart from and on opposite sides of the central axis, wherein the central axis is aligned with the channels in the upper and lower walls, wherein the upper and lower walls are space apart a first distance, wherein the channels are spaced apart a second distance, wherein the outer edges are space apart a third distance, wherein the first distance is less than the third distance, and wherein the second distance is greater than the third distance, whereby the outer edges of the vane are received in the channels when the vane is in a closed position.

2. The damper of claim 1, wherein the outer edges of the vane have a generally T-shaped cross-section.

3. The damper of claim 2, wherein the channels have an arcuate cross-section of a first radius, wherein an outer surface of the generally T-shaped outer edges has an arcuate cross-section of a second radius, and wherein the first and second radiuses are complimentary.

4. The damper of claim 1, wherein the channels have low lines, wherein the low lines are coplanar with the central axis of the damper, wherein the first and second sidewalls include a longitudinal ridge having a crest line, wherein the ridges generally extend between the channels, and wherein the crest lines of the ridges are co-planar with the low lines of the channels.

5. The damper of claim 1, wherein the first and second sidewalls include a longitudinal ridge having a crest line and wherein the crest lines are coplanar with each other and with the central axis of the damper.

6. The damper of claim 4, wherein the first and second sidewalls are spaced apart a fourth distance, wherein the crest lines are spaced apart a fifth distance which is less than the fourth distance, wherein the damper vane includes lateral edges which span between the outer edges and are spaced apart from each other a six distance, and wherein the sixth distance is less than the sixth distance.

7. The damper of claim 1, wherein at least one of the sidewalls of the housing extends outwardly therefrom and is coupled with other walls to form an air terminal with an air delivery assembly, whereby a portion of the housing is integrally formed with the air delivery assembly of the air terminal.

8. A damper comprising:

a housing having an upper wall, a lower wall, a first sidewall, and a second sidewall, wherein the upper and lower walls are spaced apart from each other a first distance and are generally parallel to each other, wherein the first and second sidewalls are spaced apart from each other a second distance and are generally parallel to each other, wherein the sidewalls are generally perpendicular to the upper and lower walls and connected thereto, thereby defining a generally rectangular air passage through the housing, wherein the upper and lower walls include a longitudinal channel therein, each channel having a longitudinal low line, wherein the channels are parallel with each other and are positioned in facing surfaces of the upper and lower walls, and wherein the channels, when measured from their low lines, are a third distance apart; and a damper vane positioned in the air passage and rotatably connected to the housing, wherein the vane includes a central longitudinal axis about which the vane rotates and which is co-planar with the low lines of the channels, wherein the vane is generally planar, is generally rectangular, has a pair of opposed longitudinal and generally parallel edges, and a pair of opposed lateral and generally parallel edges, wherein the longitudinal edges are spaced apart a fourth distance, wherein the lateral edges are spaced apart a fifth distance, and wherein the fourth distance is greater than the first distance and less than the third distance.

9. The damper of claim 8, wherein the channels have a length dimension greater than the fifth distance.

10. The damper of claim 8, wherein the vane is rotatable from a closed position, where the vane primarily prevents a flow of air through the passage, to an open position, where the vane primarily permits a flow of air through the passage, wherein vane is generally co-planar with the low lines of the channels in the closed position, and wherein the vane is perpendicular to its position in the closed position when in the open position.

11. The damper of claim 10, wherein the longitudinal edges of the vane are positioned in the channels when the vane is in the closed position.

12. The damper of claim 8, wherein the channels are arcuate in cross-section.

13. The damper of claim 12, wherein the longitudinal edges of the vane terminate in a generally T-shaped cross-section.

14. The damper of claim 13, wherein an outer surface of the longitudinal edges is arcuate and wherein the arcuate outer surfaces of the vane are complimentary in radius with the arcuate cross-section of the channels.

15. The damper of claim 8, wherein the first and second sidewalls include a longitudinal ridge, wherein the ridges have a crest line, and wherein the crest lines of the ridges are co-planar with the low lines of the channels.

16. The damper of claim 15, wherein the crest lines of the ridges are a sixth distance apart, wherein the sixth distance is greater than the fifth distance and less than the second distance.

17. The damper of claim 15, wherein the vane further includes a central axle having a central longitudinal axis and wherein the central longitudinal axis of the central axle is coaxial with the central longitudinal axis of the vane.

18. The damper of claim 17, wherein central axle includes a bore therethrough and wherein the bore is coaxial with the central longitudinal axis of the central axle.

19. The damper of claim 18, wherein the central axle is cylindrical and wherein the bore is cylindrical, whereby the central axle is tubular in nature.

20. The damper of claim 18, wherein the damper further includes a first bearing received in one end of the bore, a second bearing received in an other end of the bore, and an electric motor coupled with one of the sidewalls for rotating the vane.

21. The damper of claim 20, wherein the motor has a primary drive shaft extending from one side of the motor and a secondary drive shaft extending from an opposite side of the motor, wherein the primary drive shaft is coupled with the vane, is received in the bore of the central axle and is coaxial therewith, and wherein the secondary driveshaft includes an indicator thereon to facilitate determination of an orientation of the vane.

22. The damper of claim 21, wherein the indicator includes a reflective surface, wherein the secondary driveshaft rotates the reflective surface, wherein the reflective surface is aligned with the vane, whereby the position and orientation of the vane is ascertainable from the position of the reflective surface, and wherein the position of the reflective surface is ascertainable by a sensor detecting light reflected off of the reflective surface.

23. The damper of claim 22, wherein the indicator further includes an arm, wherein the arm has a aperture therein for receiving the secondary driveshaft, wherein the arm extends radially outwardly from the secondary driveshaft in at least one direction, and wherein the reflective surface is positioned on an outer surface of the arm.

24. The damper of claim 22, wherein the bore of the central axle includes a notch adjacent one end thereof, wherein one of the bearings includes a key in an outer surface thereof, and wherein the key is received in the notch and prevents rotation of the bearing with respect to the bore.

25. The damper of claim 24, wherein the one of the bearings with the key further includes a non-round bore, wherein the non-round bore receives the primary shaft, and wherein the primary shaft has a non-round cross-section which is complimentary to the non-round bore in the one of the bearings.

26. A damper comprising:

a housing having an upper wall, a lower wall, a first sidewall, and a second sidewall, wherein the upper and lower walls are spaced apart from each other a first distance and are generally parallel to each other, wherein the first and second sidewalls are spaced apart from each other a second distance and are generally parallel to each other, wherein the sidewalls are generally perpendicular to the upper and lower walls and connected thereto, thereby defining a generally rectangular air passage through the housing, wherein the upper and lower walls include a longitudinal channel therein, each channel having a longitudinal low line, wherein the channels are parallel with each other and are positioned in facing surfaces of the upper and lower walls, and wherein the channels, when measured from their low lines, are a third distance apart, wherein the first and second sidewalls include a longitudinal ridge therein, each ridge having a longitudinal crest line, wherein the ridges are parallel with each other and are positioned in facing surfaces of the first and second sidewalls, and wherein ridges, when measured from their crest lines, are a fourth distance apart, wherein the crest lines of the ridges are co-planar with the low lines of the channels; and a damper vane positioned in the air passage, rotatably connected to the housing, and movable between a closed position, where the vane is generally co-planar with the low lines of the channels, and an open position, where the vane is generally perpendicular to a plane containing the low lines of the channels, wherein the vane includes a central longitudinal axis about which the vane rotates and which is co-planar with the low lines of the channels and the crest lines of the ridges, wherein the vane is generally planar, is generally rectangular, has a pair of opposed longitudinal and generally parallel edges, and a pair of opposed lateral and generally parallel edges, wherein the longitudinal edges of the vane terminate in a generally T-shaped cross-section, wherein the longitudinal edges are spaced apart a fifth distance, wherein the lateral edges are spaced apart a sixth distance, wherein the third distance is greater than the first distance and less than the fifth distance, whereby the longitudinal edges are at least partially received in the channels when the vane is in the closed position, wherein the fourth distance is greater than the sixth distance and less than the second distance, and wherein the lateral edges are intermediate the ridges and the vane is co-planar with the crest lines of the ridges when the vane is in the closed position.

* * * * *